US011594180B1

(12) United States Patent
Yu et al.

(10) Patent No.: US 11,594,180 B1
(45) Date of Patent: Feb. 28, 2023

(54) PIXEL CIRCUIT AND DISPLAY DEVICE INCLUDING THE SAME

(71) Applicant: LG Display Co., Ltd., Seoul (KR)

(72) Inventors: Jae Sung Yu, Paju-si (KR); Jae Hoon Park, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/878,603

(22) Filed: Aug. 1, 2022

(30) Foreign Application Priority Data

Sep. 3, 2021 (KR) ..... 10-2021-0117326
Dec. 8, 2021 (KR) ..... 10-2021-0174576

(51) Int. Cl.
*G09G 3/3233* (2016.01)

(52) U.S. Cl.
CPC ..... *G09G 3/3233* (2013.01); *G09G 2300/0426* (2013.01); *G09G 2300/0819* (2013.01); *G09G 2300/0852* (2013.01); *G09G 2300/0861* (2013.01); *G09G 2310/02* (2013.01); *G09G 2310/0294* (2013.01); *G09G 2310/08* (2013.01); *G09G 2320/0233* (2013.01); *G09G 2330/021* (2013.01)

(58) Field of Classification Search
CPC ..... G09G 3/3233; G09G 2300/0426; G09G 2300/0819; G09G 2300/0852; G09G 2300/0861; G09G 2310/02; G09G 2310/0294; G09G 2310/08; G09G 2320/0233; G09G 2330/021
See application file for complete search history.

(56) References Cited

U.S. PATENT DOCUMENTS

2015/0154908 A1* 6/2015 Nam ..... G09G 3/3233 345/76
2018/0190197 A1* 7/2018 Chang ..... G09G 3/3233
2019/0035335 A1* 1/2019 Kim ..... G09G 3/3258
2021/0064170 A1* 3/2021 Hwang ..... G06F 3/038

FOREIGN PATENT DOCUMENTS

KR 10-2019-0076177 A 7/2019
KR 10-2020-0049219 A 5/2020
KR 10-2020-0071433 A 6/2020

* cited by examiner

*Primary Examiner* — Andrew Sasinowski
(74) *Attorney, Agent, or Firm* — Morgan, Lewis & Bockius LLP

(57) ABSTRACT

A pixel circuit and a display device including the same are disclosed. The pixel circuit includes: a driving element including electrodes respectively connected to a first node to receive a first constant voltage, a second node, and a third node; a light emitting element including an anode connected to a fourth node and a cathode to receive a second constant voltage; a first switch to provide a data voltage to the second node; a second switch to provide a third constant voltage to the second node; a third switch to provide a fourth constant voltage to the fourth node; a fourth switch to provide the first constant voltage to the first node; a fifth switch to electrically connect the third node to the fourth node.

20 Claims, 8 Drawing Sheets

PIXEL CIRCUIT AND DISPLAY DEVICE INCLUDING THE SAME

CROSS-REFERENCE TO RELATED APPLICATIONS

This application claims priority to and the benefit of Korean Patent Application No. 10-2021-0117326, filed Sep. 3, 2021, and Korean Patent Application No. 10-2021-0174576, filed Dec. 8, 2021, the disclosure of each of which is incorporated herein by reference in its entirety.

BACKGROUND

1. Technical Field

The present disclosure relates to a pixel circuit and a display device including the same.

2. Discussion of Related Art

Electroluminescence display devices may be divided into inorganic light-emitting display devices and organic light-emitting displays according to a material of an emission layer. An active matrix organic light-emitting display device includes an organic light-emitting diode (OLED) that generates light by itself and has advantages in terms of a high response rate, high luminous efficiency, high brightness, and a large viewing angle. In an organic light-emitting display device, an OLED is formed at each pixel. The organic light-emitting display device has a high response rate, high luminous efficiency, high brightness, and a large viewing angle and is capable of expressing black gradation in perfect or near perfect black, thereby achieving a high contrast ratio and a high color reproduction rate.

A pixel circuit of an organic light emitting display device includes an OLED and a driving element (e.g., a driving transistor) for driving the OLED. A data voltage and a reference voltage may be alternately applied to data lines connected to the pixel circuit. In this case, since the data lines charge and discharge the data voltage and the reference voltage in a cycle of one horizontal period, power consumption of the display device may increase.

In a state in which the driving element is connected to the OLED in such a pixel circuit, if the pixel circuit is driven in a sampling period and an addressing period, the luminance of the pixels may change under the influence of the resistance and the capacitance of the OLED. If there is a deviation between the resistance and the capacitance of the OLED between the pixels due to the process deviation of the OLED, the luminance non-uniformity between the pixels may appear more severe.

For example, when the data voltage is applied to the gate electrode of the driving element while the driving element is connected to the OLED, a gate-source voltage of the driving element may change under the influence of a voltage charged in a previous frame due to the internal high resistance of the OLED, so that the luminance of the pixel may also change. For example, if the luminance of the pixel is high in the previous frame, the gate-source voltage of the driving element may decrease since the internal node voltage of the OLED is high in the sampling period of a current frame. Thus, the luminance of the pixel may decrease. Conversely, if the luminance of the pixel is low in the previous frame, the gate-source voltage of the driving element may increase since the internal node voltage of the OLED is low in the sampling period of the current frame. Thus, the luminance of the pixel may increase.

SUMMARY

Accordingly, embodiments of the present disclosure are directed to a pixel circuit and a display device including the same that substantially obviate one or more problems due to limitations and disadvantages of the related art.

The present disclosure provides a pixel circuit capable of improving power consumption and preventing the influence of a light emitting element on the luminance of the pixel when pixel data is written into pixels, and a display device including the same.

Aspects of the present disclosure are not limited to those described above. Additional features and aspects will be set forth in part in the description that follows, and in part will become apparent from the description, or may be learned by practice of the inventive concepts provided herein. Other features and aspects of the inventive concepts may be realized and attained by the structure particularly pointed out in, or derivable from, the written description, the claims hereof, and the appended drawings.

To achieve these and other aspect of the inventive concepts, as embodied and broadly described herein, a pixel circuit may include: a driving element including a first electrode connected to a first node configured to receive a first constant voltage, a gate electrode connected to a second node, and a second electrode connected to a third node; a light emitting element including an anode electrode connected to a fourth node and a cathode electrode configured to receive a second constant voltage lower than the first constant voltage; a first switch configured to provide a data voltage to the second node based on a first gate pulse; a second switch configured to provide a third constant voltage lower than the first constant voltage to the second node based on a second gate pulse; a third switch configured to provide a fourth constant voltage lower than the third constant voltage and higher than the second constant voltage to the fourth node based on a third gate pulse; a fourth switch configured to provide the first constant voltage to the first node based on a fourth gate pulse; a fifth switch configured to electrically connect the third node to the fourth node based on a fifth gate pulse; a first capacitor connected between the second node and the third node; and a second capacitor connected between the third node and a constant voltage node.

The constant voltage node may be configured to receive one of the first, second, third, and fourth constant voltages.

A voltage difference between the third constant voltage and the fourth constant voltage may be higher than a threshold voltage of the driving element.

A driving period of the pixel circuit may include an initialization period, a sampling period following the initialization period, an addressing period following the sampling period, and a light emission period following the addressing period. In the initialization period, the second, third, and fifth switches and the driving element may be configured to be turned on, and the first and fourth switches may be configured to be turned-off. In the sampling period, the second and fourth switches may be configured to be turned on, and the first, third, and fifth switches may be configured to be turned off. In the addressing period, the first switch may be configured to be turned on, and the second, third, fourth, and fifth switches may be configured to be turned off. In the light emission period, the fourth and fifth switches may be configured to be turned on, and the first, second, and third switches may be configured to be turned off.

The driving element may be configured to be turned on in the initialization period and to be turned off in the sampling period.

The third node may be configured to be electrically disconnected from the fourth node in the sampling period and the addressing period.

The first to the fifth switches may be configured to be turned on in response to a gate-on voltage and turned-off in response to a gate-off voltage. The first gate pulse may be configured to be generated as the gate-on voltage in the addressing period in synchronization with the data voltage, and to be generated as the gate-off voltage in the initialization period, the sampling period, and the light emission period. The second gate pulse may be configured to be generated as the gate-on voltage in the initialization period and the sampling period, and to be generated as the gate-off voltage in the addressing period and the light emission period. The third gate pulse may be configured to be generated as the gate-on voltage in the initialization period, and to be generated as the gate-off voltage in the sampling period, the addressing period, and the light emission period. The fourth gate pulse may be configured to be generated as the gate-on voltage in the sampling period and the light emission period, and to be generated as the gate-off voltage in the initialization period and the addressing period. The fifth gate pulse may be configured to be generated as the gate-on voltage in the initialization period and the light emission period, and to be generated as the gate-off voltage in the sampling period and the addressing period.

A driving period of the pixel circuit may include a first initialization period, a sampling period following the first initialization period, an addressing period following the sampling period, a second initialization period following the addressing period, and a light emission period following the second initialization period. In the first initialization period, the second, third, and fifth switches and the driving element may be configured to be turned on, and the first and fourth switches may be configured to be turned-off. In the sampling period, the second and fourth switches may be configured to be turned on, and the first, third, and fifth switches may be configured to be turned off. In the addressing period, the first switch may be configured to be turned on, and the second, third, fourth, and fifth switches may be configured to be turned off. In the second initialization period, the third and fifth switches may be configured to be turned on, and the first, second, and fourth switches may be configured to be turned off. In the light emission period, the fourth and fifth switches may be configured to be turned on, and the first, second, and third switches may be configured to be turned off.

The first to the fifth switches may be configured to be turned on in response to a gate-on voltage and to be turned-off in response to a gate-off voltage. The first gate pulse may be configured to be generated as the gate-on voltage in the addressing period in synchronization with the data voltage, and to be generated as the gate-off voltage in the first initialization period, the sampling period, the second initialization period, and the light emission period. The second gate pulse may be configured to be generated as the gate-on voltage in the first initialization period and the sampling period, and to be generated as the gate-off voltage in the addressing period, the second initialization period, and the light emission period. The third gate pulse may be configured to be generated as the gate-on voltage in the first initialization period and the second initialization period, and to be generated as the gate-off voltage in the sampling period, the addressing period, and the light emission period. The fourth gate pulse may be configured to be generated as the gate-on voltage in the sampling period and the light emission period, and to be generated as the gate-off voltage in the first initialization period, the addressing period, and the second initialization period. The fifth gate pulse may be configured to be generated as the gate-on voltage in the first initialization period, the second initialization period, and the light emission period, and to be generated as the gate-off voltage in the sampling period and the addressing period.

A gate-source voltage of the driving element may be configured to depend on a capacitance of the second capacitor. The gate-source voltage of the driving element may be configured to change based on the data voltage.

In another aspect, a display device may include: a display panel including a plurality of data lines, a plurality of gate lines intersecting the plurality of data lines, a plurality of power lines, and a plurality of pixel circuits respectively connected to the plurality of data lines, the plurality of gate lines, and the plurality of power lines; a data driver configured to provide a data voltage of pixel data to the plurality of data lines; and a gate driver configured to provide a gate signal to the plurality of gate lines. At least one of the plurality of pixel circuits may be any of the pixel circuits described above in this section.

The first switch may be configured to provide the data voltage from a corresponding one of the data lines to the second node based on the first gate pulse. The second switch may be configured to provide the third constant voltage from one of the power lines to the second node based on the third gate pulse.

Each of the driving element and the first, second, third, fourth and fifth switches of the pixel circuit may include an n-channel oxide semiconductor.

In the present disclosure, since a data line through which a data voltage is applied and a power line through which a reference voltage is applied may be separate, the frequency of a voltage applied to the data line may be lowered so that power consumption may be reduced.

In the present disclosure, in the sampling period and the addressing period, the driving element of the pixel circuit may be electrically separated from the light emitting element. As a result, in the present disclosure, since data addressing and threshold voltage sampling of the driving element are not affected by a resistance of the light emitting element and a process deviation of the light emitting element, the influence of the light emitting element on the luminance of the pixel may be prevented. Accordingly, it is possible to prevent the change of the luminance of the pixel due to the influence of the light emitting element.

Effects of the present disclosure are not limited to those mentioned above, and other effects not mentioned may be apparent to or understood by those skilled in the art from the following description and the appended claims.

It is to be understood that both the foregoing general description and the following detailed description of the present disclosure are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Figure 1:
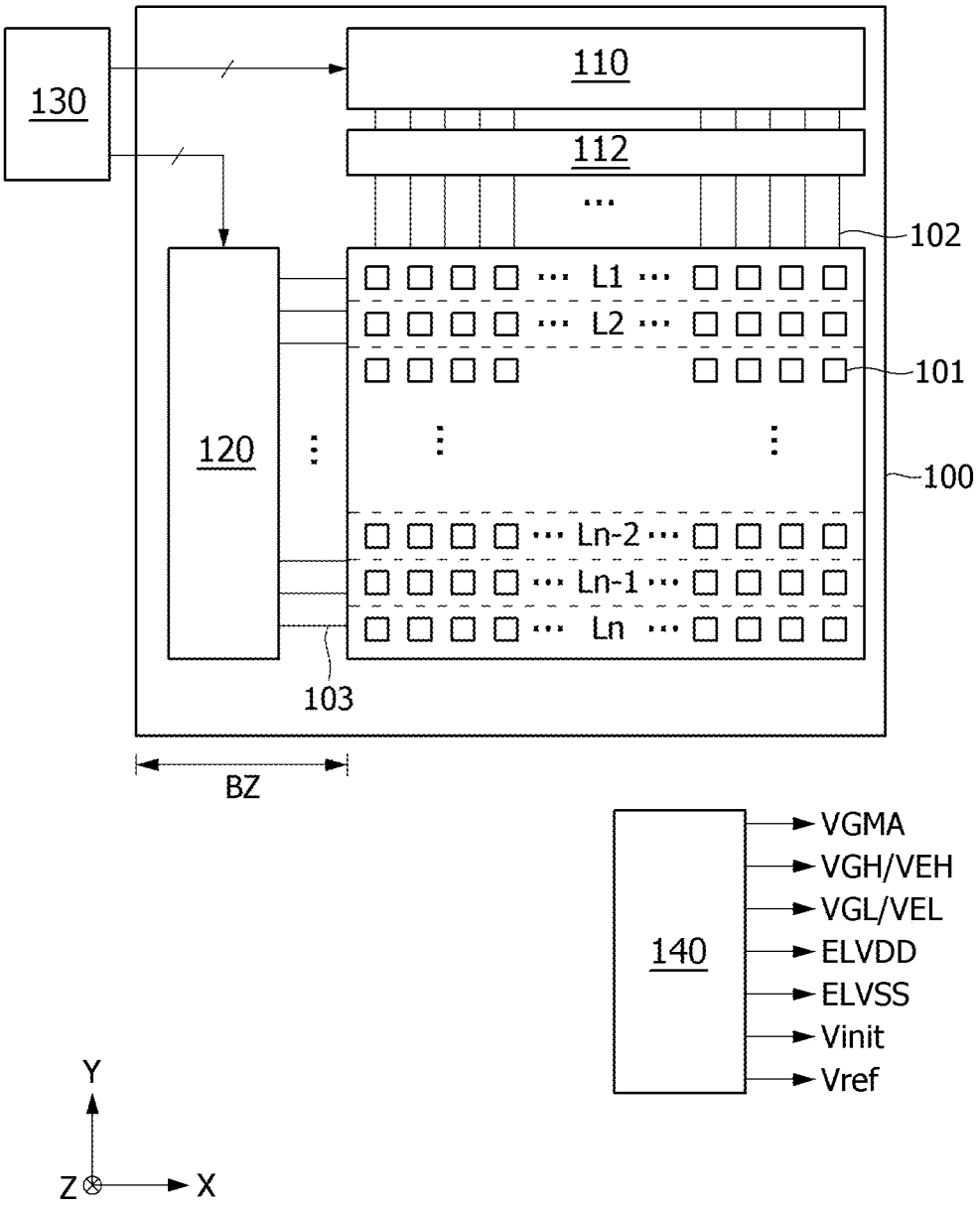
FIG. 1 is a block diagram illustrating a display device according to an example embodiment of the present disclosure.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure. Further, the protected scope of the present disclosure is defined by claims and their equivalents.

The shapes, sizes, ratios, angles, numbers, and the like, which are illustrated in the drawings to describe various example embodiments of the present disclosure, are merely given by way of example. Therefore, the present disclosure is not limited to the illustrations in the drawings. The same or similar elements are designated by the same reference numerals throughout the specification unless otherwise specified.

In the following description, where the detailed description of the relevant known function or configuration may unnecessarily obscure an important point of the present disclosure, a detailed description of such known function or configuration may be omitted.

In the present specification, where the terms "comprise," "have," "include," and the like are used, one or more other elements may be added unless the term, such as "only," is used. An element described in the singular form is intended to include a plurality of elements, and vice versa, unless expressly stated otherwise or the context clearly indicates otherwise.

In construing an element, the element is to be construed as including an ordinary error or tolerance range even where no explicit description of such an error or tolerance range is provided.

In the description of the various embodiments of the present disclosure, where positional relationships are described, for example, where the positional relationship between two parts is described using "on," "over," "under," "above," "below," "beside," "next," or the like, one or more other parts may be located between the two parts unless a more limiting term, such as "immediate(ly)," "direct(ly)," or "close(ly)" is used. For example, where an element or layer is disposed "on" another element or layer, a third layer or element may be interposed therebetween.

Although the terms "first," "second," and the like may be used herein to describe various elements, the elements should not be limited by these terms as they are not used to define a particular order, precedence, or number of the corresponding elements. These terms are used only to identify one element from another. For example, a first element could be termed a second element, and similarly, a second element could be termed a first element, without departing from the scope of the present disclosure.

The same reference numerals may refer to substantially the same elements throughout the present disclosure unless otherwise specified.

Features of various embodiments of the present disclosure may be partially or entirely coupled to or combined with each other. They may be linked and operated technically in various ways as those skilled in the art can sufficiently understand. The embodiments may be carried out independently of or in association with each other in various combinations.

Each of the pixels may include a plurality of sub-pixels having different colors to reproduce the color of the image on a screen of the display panel. Each of the sub-pixels includes a transistor used as a switch element or a driving element. Such a transistor may be implemented as a TFT (Thin Film Transistor).

A driving circuit of the display device writes a pixel data of an input image to pixels on the display panel. To this end, the driving circuit of the display device may include a data driving circuit configured to supply data signal to the data lines, a gate driving circuit configured to supply a gate signal to the gate lines, and the like.

In a display device according to example embodiments of the present disclosure, the pixel circuit may include a plurality of transistors. The transistors may be implemented as oxide thin film transistors (oxide TFTs) including an n-channel oxide semiconductor, low temperature polysilicon (LTPS) TFTs including low temperature polysilicon, or the like. In the example embodiments, descriptions will be given based on an example in which the transistors of the pixel circuit are implemented as the n-channel oxide TFTs, but the present disclosure is not limited thereto.

A transistor is a three-electrode element including a gate, a source, and a drain. The source is an electrode configured to supply carriers to the transistor. In the transistor, carriers may start to flow from the source. The drain is an electrode through which carriers may exit from the transistor. In a transistor, carriers may flow from a source to a drain. In the case of an n-channel transistor, since carriers are electrons, a source voltage is configured to be lower than a drain voltage such that electrons may flow from a source to a drain. The n-channel transistor has a direction of a current flowing from the drain to the source. In the case of a p-channel transistor, e.g., p-channel metal-oxide semiconductor (PMOS), since carriers are holes, a source voltage is configured to be higher than a drain voltage such that holes may flow from a source to a drain. In the p-channel transistor, since holes flow from the source to the drain, a current flows from the source to the drain. It should be noted that a source and a drain of a transistor are not fixed. For example, a source and a drain may be switched according to an applied voltage. Therefore, the disclosure is not limited based on a reference to a given electrode of a transistor as a source or a drain of the transistor. In the following description, a source and a drain of a transistor will be referred to as a first electrode and a second electrode.

A gate signal is configured to swing between a gate-on voltage and a gate-off voltage. The gate-on voltage is set to a voltage higher than a threshold voltage of a transistor, and the gate-off voltage is set to a voltage lower than the threshold voltage of the transistor.

The transistor is turned on in response to the gate-on voltage and is turned off in response to the gate-off voltage. In the case of an n-channel transistor, a gate-on voltage may be a gate high voltage VGH and VEH, and a gate-off voltage may be a gate low voltage VGL and VEL.

Reference will now be made in detail to embodiments of the present disclosure, examples of which may be illustrated in the accompanying drawings. In the following description of example embodiments, a display device will be mainly described as an organic light emitting display device, but the present disclosure is not limited thereto.

Figure 2:
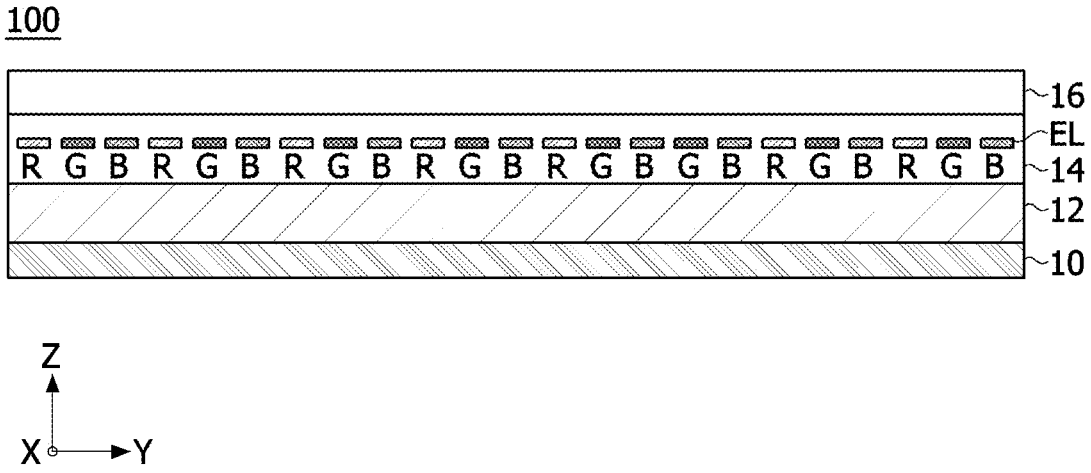
FIG. 2 is a cross-sectional view illustrating a cross-sectional structure of an example display panel shown in FIG. 1.

As shown in FIGS. 1 and 2, a display device according to an embodiment of the present disclosure may include a display panel 100, a display panel driver for writing pixel data to pixels of the display panel 100, and a power supply unit 140 for generating power required to drive the pixels and the display panel driver.

The display panel 100 may have a rectangular structure having a length in an X-axis direction, a width in a Y-axis direction, and a thickness in a Z-axis direction. The display panel 100 may include a pixel array that displays an input image on a screen. The pixel array 100 may include a plurality of data lines 102, a plurality of gate lines 103 intersecting the data lines 102, and pixels 101 arranged in a matrix form. The display panel 100 may further include power lines commonly connected to the pixels. The power lines may supply the pixels 101 with a constant voltage or voltages for driving the pixels 101. For example, the display panel 100 may include a VDD line through which a pixel driving voltage ELVDD may be applied and a VSS line through which a low potential power voltage ELVSS may be applied. In addition, the power lines may further include a REF line through which a reference voltage Vref may be applied and an INIT line through which an initialization voltage Vinit may be applied.

As shown in FIG. 2, the cross-sectional structure of the display panel 100 may include a circuit layer 12, a light emitting element layer 14, and an encapsulation layer 16 stacked on a substrate 10.

The circuit layer 12 may include a TFT array including a pixel circuit connected to wires, such as the data line, the gate line, and the power line, a demultiplexer array 112, a gate driver 120, and the like. The wires and circuit elements of the circuit layer 12 may include a plurality of insulating layers, two or more metal layers separated from one another with the insulating layer(s) therebetween, and an active layer including a semiconductor material. All transistors formed in the circuit layer 12 may be implemented with n-channel oxide TFTs, but the present disclosure is not limited thereto.

The light emitting element layer 14 may include light emitting elements EL configured to be driven by the pixel circuit. The light emitting elements EL may include a red (R) light emitting element, a green (G) light emitting element, and a blue (B) light emitting element. In another embodiment, the light emitting element layer 14 may include a white light emitting element and a color filter. The light emitting elements EL of the light emitting element layer 14 may be covered with a multi-layered protective layer including an organic film and an inorganic film.

The encapsulation layer 16 may cover the light emitting element layer 14 to seal the circuit layer 12 and the light emitting element layer 14. The encapsulation layer 16 may have a multi-layer insulating film structure in which an organic film and an inorganic film are alternately stacked. The inorganic film may block the penetration of moisture and oxygen. The organic film may planarize the surface of the inorganic film. When the organic film and the inorganic film are stacked in multiple layers, the movement path of moisture or oxygen becomes longer than that in a single layer, so that the penetration of moisture and oxygen affecting the light emitting element layer 14 may be effectively blocked.

A touch sensor layer, which is not illustrated in the drawing, may be formed on the encapsulation layer 16, and a polarizing plate or a color filter layer may be disposed thereon. The touch sensor layer may include capacitive touch sensors that sense a touch input based on a change in capacitance before and after the touch input. The touch sensor layer may include insulating layers and metal or conductive wiring patterns that form the capacitance of the touch sensors. The insulating layers may insulate intersecting portions in the metal or conductive wiring patterns and may planarize the surface of the touch sensor layer. The polarizing plate may improve visibility and contrast ratio by converting the polarization of external light reflected by the metal of the circuit layer and the touch sensor layer. The polarizing plate may be implemented as a circular polarizing plate or a polarizing plate in which a linear polarizing plate and a phase retardation film are bonded. A cover glass may be bonded to the polarizing plate. The color filter layer may include red, green, and blue color filters. The color filter layer may further include a black matrix pattern. The color filter layer may absorb a part of the wavelength of light reflected from the circuit layer and the touch sensor layer to replace the polarizing plate and increase the color purity of an image reproduced in the pixel array.

The pixel array may include a plurality of pixel lines L1 to Ln. Each of the pixel lines L1 to Ln may include one line of pixels arranged along a line direction (X-axis direction) in the pixel array of the display panel 100. The pixels arranged in one pixel line may share a corresponding one of the gate lines 103. Sub-pixels arranged in a column direction Y along a data line direction may share the same data line 102. One horizontal period may be a time period obtained by dividing one frame period by the total number of the pixel lines L1 to Ln.

The display panel 100 may be implemented as a non-transmissive display panel or a transmissive display panel. The transmissive display panel may be applied to a transparent display device in which an image is displayed on a screen and an actual background is visible. The display panel 100 may be manufactured as a flexible display panel.

Each of the pixels 101 may be divided into a red sub-pixel, a green sub-pixel, and a blue sub-pixel to implement color. Each of the pixels may further include a white sub-pixel. Each of the sub-pixels may include the pixel circuit. Hereinafter, a pixel may be interpreted as having the same meaning as a sub-pixel. Each pixel circuit may be connected to a corresponding one of the data lines, a corresponding one of the gate lines, and one or more of the power lines.

The pixels may be arranged as real color pixels and/or pentile pixels. A pentile pixel may realize a higher resolution than a real color pixel by driving two sub-pixels having different colors as one pixel 101 by using a preset pixel rendering algorithm. The pixel rendering algorithm may compensate for insufficient color representation in each pixel with the color of light emitted from an adjacent pixel.

The power supply unit 140 may generate a DC voltage (or constant voltage) for driving the pixel array of the display panel 100 and the display panel driver by using a DC-DC converter. The DC-DC converter may include a charge pump, a regulator, a buck converter, a boost converter, and the like. The power supply unit 140 may adjust the level of a DC input voltage applied from a host system (not shown) to generate DC voltages (or constant voltages) such as a gamma reference voltage VGMA, gate-on voltages VGH and VEH, gate-off voltages VGL and VEL, the pixel driving voltage ELVDD, the low potential power voltage ELVSS, the initialization voltage Vinit, and the reference voltage Vref. The gamma reference voltage VGMA may be supplied to a data driver 110. The gate-on voltages VGH and VEH and the gate-off voltages VGL and VEL may be supplied to the gate driver 120. The constant voltages, such as the pixel driving voltage ELVDD, the low potential power voltage ELVSS, the initialization voltage Vinit, and the reference voltage Vref, may be supplied to the pixels 101 through the power lines commonly connected to the pixels 101. The constant voltages applied to the pixel circuit may have different voltage levels.

The display panel driver may write pixel data of an input image to the pixels 101 of the display panel 100 under the control of the timing controller 130.

The display panel driver may include the data driver 110 and the gate driver 120. The display panel driver may further include a demultiplexer array 112 disposed between the data driver 110 and the data lines 102.

The demultiplexer array 112 may sequentially supply the data voltages outputted from the channels of the data driver 110 to the data lines 102 using a plurality of demultiplexers DEMUX. The demultiplexers may include a plurality of switch elements disposed on the display panel 100. When the demultiplexer is disposed between the data lines 102 and the output terminals of the data driver 110, the number of channels of the data driver 110 may be reduced. The demultiplexer array 112 may be omitted.

The display panel driver may further include a touch sensor driver for driving the touch sensors. The touch sensor driver is not illustrated in FIG. 1. The data driver 110 and the touch sensor driver may be integrated into one drive integrated circuit (IC). In a mobile device or a wearable device, the timing controller 130, the power supply unit 140, the data driver 110, and the like may be integrated into one drive IC.

The display panel driver may operate in a low-speed driving mode under the control of the timing controller 130. The low-speed driving mode may be set to reduce power consumption of the display device when an input image does not change by a preset number of frames as a result of analyzing the input image. In the low-speed driving mode, power consumption of the display panel driver and the display panel 100 may be reduced by lowering a refresh rate of the pixels when a still image is inputted for a predetermined time or longer. The low-speed driving mode may be configured to be not limited to when a still image is inputted. For example, when the display device operates in a standby mode or when a user command or an input image is not inputted to the display panel driver for a predetermined time or longer, the display panel driver may operate in the low-speed driving mode.

The data driver 110 may receive the pixel data of the input image received as a digital signal from the timing controller 130 and may output a data voltage. The data driver 110 may convert the pixel data of the input image into a gamma compensation voltage every frame period using a digital to analog converter (DAC) to generate a data voltage Vdata. The gamma reference voltage VGMA may be divided into a gamma compensation voltage for each grayscale through a voltage divider circuit. The gamma compensation voltage for each grayscale may be provided to the DAC of the data driver 110. The data voltage Vdata may be outputted from each of the channels of the data driver 110 through an output buffer.

The gate driver 120 may be implemented as a gate in panel (GIP) circuit formed in a circuit layer 12 on the display panel 100 together with various wires and a TFT array of the pixel array. The gate driver 120 may be disposed in a bezel BZ, which is the non-display area of the display panel 100, or may be distributedly disposed in the pixel array where the input image is reproduced. The gate driver 120 may sequentially output the gate signal to the gate lines 103 under the control of the timing controller 130. The gate driver 120 may shift the gate signal by using a shift register to sequentially supply the signals to the gate lines 103. The gate signal may include various gate pulses such as a scan pulse and an emission control pulse (hereinafter, referred to as an "EM pulse").

The timing controller 130 may receive digital video data DATA of the input image and a timing signal synchronized with the digital video data DATA from the host system (not illustrated). The timing signal may include a vertical synchronization signal Vsync, a horizontal synchronization signal Hsync, a clock CLK, a data enable signal DE, and the like. Since a vertical period and a horizontal period can be known by counting the data enable signal DE, the vertical synchronization signal Vsync and the horizontal synchronization signal Hsync may be omitted. The data enable signal DE may have a cycle of one horizontal period 1H.

The host system may be any one of a television (TV) system, a tablet computer, a laptop computer, a navigation system, a personal computer (PC), a home theater system, a mobile device, a wearable device, and a vehicle system, but the present disclosure is not limited thereto. The host system may scale an image signal from a video source to fit the resolution of the display panel 100 and transmit it to the timing controller 130 together with the timing signal.

In a normal driving mode, the timing controller 130 may multiply an input frame frequency by i times (i being a natural number) to control the operation timing of the display panel driver with a frame frequency of the input frame frequency×i Hz. For example, the input frame frequency is 60 Hz in a national television standards committee (NTSC) method and 50 Hz in a phase-alternating line (PAL) method.

The timing controller 130 may lower the frequency of the frame rate at which a pixel data is written to the pixels in the low-speed driving mode, compared to the frequency in the normal driving mode. For example, a data refresh frame frequency at which a pixel data is written to the pixels in the normal driving mode may be generated at a frequency of 60 Hz or higher, e.g., a refresh rate of any one of 60 Hz, 120 Hz, and 144 Hz, and a data refresh frame DRF in the low-speed driving mode may be generated at a refresh rate of a lower frequency than that in the normal driving mode.

Based on the timing signals Vsync, Hsync, and DE received from the host system, the timing controller 130 may generate a data timing control signal for controlling the operation timing of the data driver 110, a control signal for controlling the operation timing of the demultiplexer array 112, and a gate timing control signal for controlling the operation timing of the gate driver 120. The timing controller 130 may control the operation timing of the display panel driver to synchronize the data driver 110, the demultiplexer array 112, the touch sensor driver, and the gate driver 120.

The gate timing control signal generated from the timing controller 130 may be inputted to the shift register of the gate driver 120 through a level shifter (not shown). The level shifter may receive the gate timing control signal to generate a start pulse and a shift clock and may provide the start pulse and the shift clock to the shift register of the gate driver 120.

Figure 3:
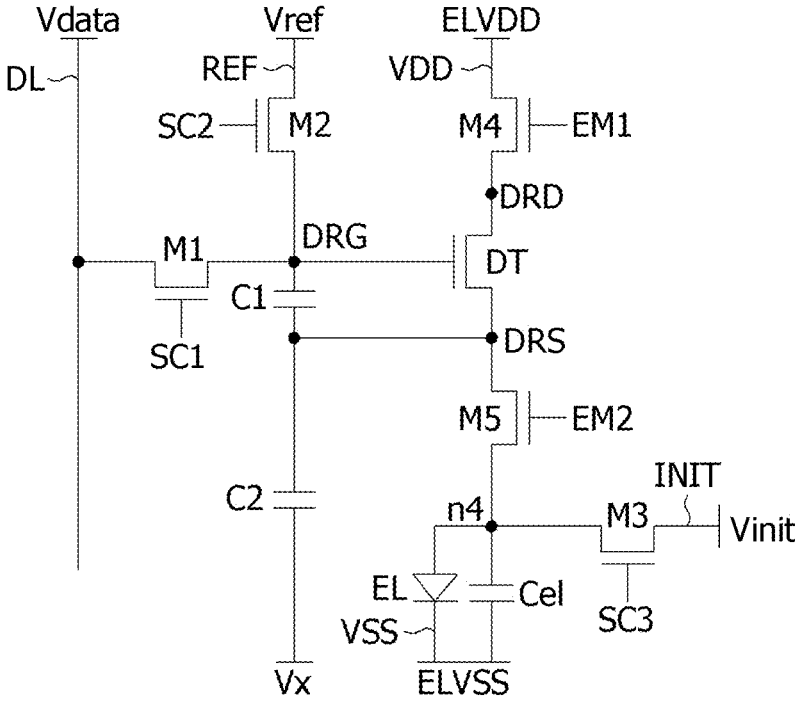
FIG. 3 is a circuit diagram illustrating a pixel circuit according to an example embodiment of the present disclosure.
Figure 4:
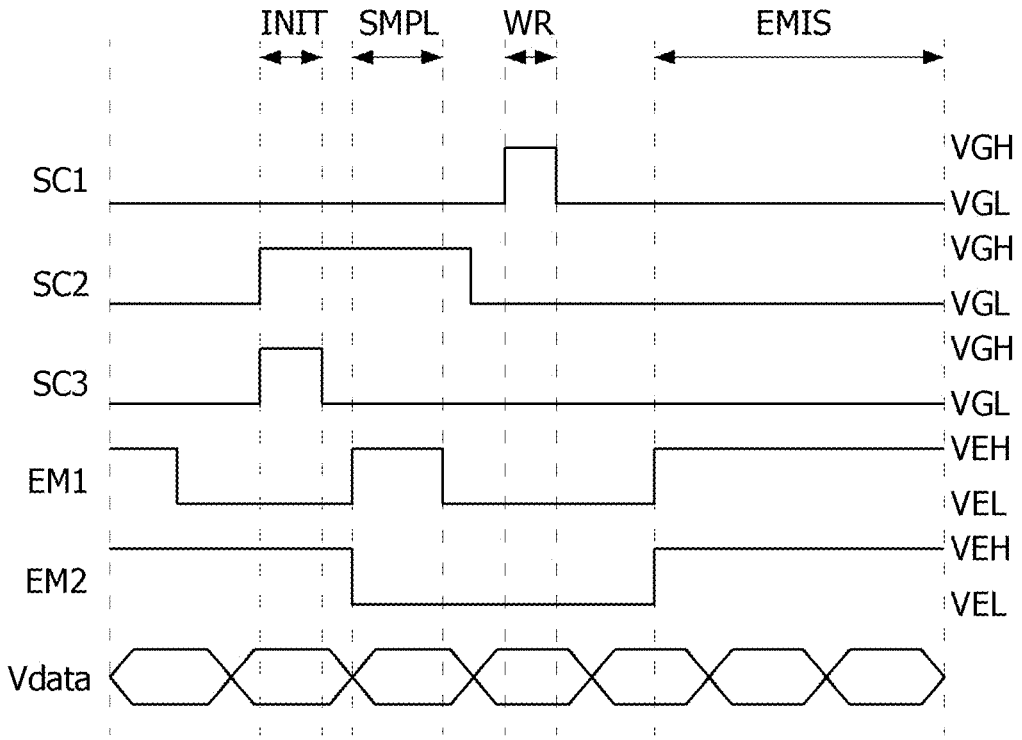
FIG. 4 is a waveform diagram illustrating a method of driving a pixel circuit according to an example embodiment of the present disclosure.

FIG. 3 is a circuit diagram illustrating a pixel circuit according to an example embodiment of the present disclosure. FIG. 4 is a waveform diagram illustrating a method of driving a pixel circuit according to an example embodiment of the present disclosure.

As illustrated in FIGS. 3 and 4, the pixel circuit may include a light emitting element EL, a driving element DT for supplying a current to the light emitting element EL, a plurality of switch elements M1 to M5, a first capacitor C1, and a second capacitor C2. In this example pixel circuit, the driving element DT and the switch elements M1 to M5 may be implemented with n-channel oxide TFTs, but the present disclosure is not limited thereto.

The gate signals may include a first scan pulse (or a first gate pulse) SC1, a second scan pulse (or a second gate pulse) SC2, a third scan pulse (or a third gate pulse) SC3, a first EM pulse (or a fourth gate pulse) EM1, and a second EM pulse (or a fifth gate pulse) EM2. To drive the example pixel circuit shown in FIG. 3, the gate driver 120 may include a first shift register sequentially outputting the first scan pulse SC1 and a second shift register sequentially outputting the second scan pulse SC2, a third shift register sequentially outputting the third scan pulse SC3, a fourth shift register sequentially outputting the first EM pulse EM1, and a fifth shift register sequentially outputting the second EM pulse EM2.

The constant voltages, such as the pixel driving voltage ELVDD, the low potential power voltage ELVSS, the reference voltage Vref, and the initialization voltage Vinit, may be applied to the pixel circuit. The pixel driving voltage ELVDD may be higher than the low potential power voltage ELVSS. The gate-on voltages VGH and VEH may be set to be higher than the pixel driving voltage ELVDD. The gate-off voltages VGL and VEL may be set to be lower than the low potential power voltage ELVSS. The initialization voltage Vinit may be set to a low potential voltage higher than the low potential power voltage ELVSS. The reference voltage Vref may be set to a voltage at which the driving element DT can be turned on. The reference voltage Vref may be set to be within a voltage range of the data voltage Vdata outputted from the data driver 110. The maximum voltage of the data voltage Vdata may be lower than the pixel driving voltage ELVDD, and the minimum voltage of the data voltage Vdata may be higher than the low potential power voltage ELVSS.

To sample a threshold voltage Vth of the driving element DT in a sampling period SMPL, the reference voltage Vref may preferably be set to a voltage higher than the initialization voltage Vinit. The voltage difference between the reference voltage Vref and the initialization voltage Vinit may be set to be greater than the threshold voltage Vth of the driving element DT. The initialization voltage Vinit may be set to a voltage lower than the threshold voltage of the light emitting element EL to realize the lowest luminance, i.e., the luminance of the black grayscale of the pixel.

As shown in FIG. 4, the driving period of the pixel circuit may include an initialization period INIT, the sampling period SMPL set following the initialization period INIT, an addressing period WR set following the sampling period SMPL, and a light emission period EMIS set following the addressing period WR.

The first scan pulse SC1 may be generated as the gate-on voltage VGH in the addressing period WR in synchronization with the data voltage Vdata of the pixel data. The first scan pulse SC1 may be at the gate-off voltage VGL in the initialization period INIT, the sampling period SMPL, and the light emission period EMIS. The second scan pulse SC2 may be generated as the gate-on voltage VGH in the initialization period INIT and the sampling period SMPL. The second scan pulse SC2 may be at the gate-off voltage VGL in the addressing period WR and the light emission period EMIS. The third scan pulse SC3 may be generated as the gate-on voltage VGH in the initialization period INIT. The third scan pulse SC3 may be at the gate-off voltage VGL in the sampling period SMPL, the addressing period WR, and the light emission period EMIS.

The first EM pulse EM1 may be at the gate-off voltage VEL in the initialization period INIT and the addressing period WR. The first EM pulse EM1 may be generated as the gate-on voltage VEH in the sampling period SMPL and the light emission period EMIS.

The second EM pulse EM2 may be generated as the gate-on voltage VEH in the initialization period INIT and the light emission period EMIS. The second EM pulse EM2 may be at the gate-off voltage VEL in the sampling period SMPL and the addressing period WR.

The switch elements M1 to M5 may be turned on when the gate-on voltage VGH or VEH is applied to their respective gate electrodes, whereas they are turned off when the gate-off voltage VGL or VEL is applied to their respective gate electrodes. The driving element DT may be turned on when the gate-source voltage Vgs is higher than the threshold voltage Vth, and may generate a current according to the gate-source voltage Vgs to drive the light emitting element EL.

The light emitting element EL may be implemented with an OLED. The OLED may include an organic compound layer formed between an anode electrode and a cathode electrode. The organic compound layer may include a hole injection layer (HIL), a hole transport layer (HTL), an emission layer (EML), an electron transport layer (ETL), and an electron injection layer (EIL), but is not limited thereto. The anode electrode of the light emitting element EL may be connected to a fourth node n4, and the cathode electrode thereof may be connected to a VSS line to which the low potential power voltage ELVSS is applied. The light emitting element EL may include a capacitor Cel formed between an anode electrode and a cathode electrode. The OLED used as the light emitting element EL may have a tandem structure in which a plurality of light emitting layers are stacked. The OLED having a tandem structure may improve the luminance and lifespan of the pixel.

When a voltage is applied across the anode and cathode electrodes of the light emitting element EL, holes passing through the hole transport layer (HTL) and electrons passing through the electron transport layer (ETL) move to the emission layer (EML) to form excitons. In this case, visible light may be emitted from the emission layer EML.

The driving element DT may include a gate electrode connected to a second node DRG, a first electrode connected to a first node DRD, and a second electrode connected to a third node DRS. Accordingly, voltages applied to the electrodes of the driving element DT may be the same as the voltages at the first to third nodes DRD, DRG, and DRS, respectively.

The first capacitor C1 may be connected between the second node DRG and the third node DRS. The first capacitor C1 may store the gate-source voltage Vgs of the driving element DT. The second capacitor C2 may be connected between the third node DRS and a constant voltage node Vx. A constant voltage, e.g., any one of the pixel driving voltage ELVDD, the low-potential power voltage ELVSS, the reference voltage Vref, and the initialization voltage Vinit, may be applied to the constant voltage node Vx. The constant voltage node Vx may be connected to the VDD line through which a relatively stable constant voltage, e.g., the pixel driving voltage ELVDD is applied.

The transmission rate of the data voltage Vdata at the gate-source voltage Vgs of the driving element DT is determined according to the capacitance ratio of the first capacitor C1 and the second capacitor C2. The capacitances of the first capacitor C1 and the second capacitor C2 may be appropriately selected according to the voltage range of the data voltage Vdata and the driving characteristics of the display panel.

In the example pixel circuit shown in FIG. 3, the gate-source voltage Vgs of the driving element DT may have a value of (1-C')*(Vdata-Vref)+Vth in the light emission period EMIS. Here, C'=C1/(C1+C2). If C2=0, C' becomes 1, and (1-C') becomes 0 (zero) in the above calculation formula, so the gate-source voltage Vgs becomes equal to the threshold voltage Vth. Accordingly, for the gate-source voltage Vgs of the driving element DT to change according to the data voltage Vdata of the pixel data, the second capacitor C2 may be used.

A first switch element M1 may be turned on in response to the gate-on voltage VGH of the first scan pulse SC1 to supply the data voltage Vdata to the second node DRG in the addressing period WR. The first switch element M1 may include a gate electrode connected to a first gate line through which the first scan pulse SC1 may be applied, a first electrode connected to a data line DL through which the data voltage Vdata may be applied, and a second electrode connected to the second node DRG.

The second switch element M2 may be turned on in response to the gate-on voltage VGH of the second scan pulse SC2 to supply the reference voltage Vref to the second node DRG in the initialization period INIT and the sampling period SMPL. The second switch element M2 may include a gate electrode connected to a second gate line through which the second scan pulse SC2 may be applied, a first electrode connected to the REF line through which the reference voltage Vref may be applied, and a second electrode connected to the second node DRG.

If the data voltage Vdata and the reference voltage Vref are applied to the pixel circuit through the data line DL, the number of transitions applied to the data line DL increases, that is, the frequency increases, and thus power consumption of the display device increases. In contrast, in an example embodiment of the present disclosure, since the data line DL through which the data voltage Vdata may be applied and the REF line through which the reference voltage Vref may be applied are separate from each other, the frequency of the voltage applied to the data line DL may be lowered so that power consumption may be reduced.

The third switch element M3 may be turned on in response to the gate-on voltage VGH of the third scan pulse SC3 to apply the initialization voltage Vinit to the fourth node n4 in the initialization period INIT. The third switch element M3 may include a gate electrode connected to a third gate line through which the third scan pulse SC3 may be applied, a first electrode connected to the fourth node n4, and a second electrode connected to the INIT line through which the initialization voltage Vinit may be applied.

The fourth switch element M4 may be turned off in response to the gate-off voltage VEL of the first EM pulse EM1 to cut off a current path between the VDD line, through which the pixel driving voltage ELVDD may be applied, and the first node DRD in the initialization period INIT and the addressing period WR. The fourth switch element M4 may be turned on in response to the gate-on voltage VEH of the first EM pulse EM1 to connect the VDD line to the first node DRD in the sampling period SMPL and the light emission period EMIS. The fourth switch element M4 may include a gate electrode connected to a fourth gate line through which the first EM pulse EM1 may be applied, a first electrode connected to the VDD line, and a second electrode connected to the first node DRD.

The fifth switch element M5 may be turned off in response to the gate-off voltage VEL of the second EM pulse EM2 to cut off a current path between the third node DRS and the fourth node n4 in the sampling period SMPL and the addressing period WR. The fifth switch element M5 may be turned on in response to the gate-on voltage VEH of the second EM pulse EM2 to form a current path between the driving element DT and the light emitting element EL in the initialization period INIT and the light emission period EMIS. The fifth switch element M5 may include a gate electrode connected to a fifth gate line through which the second EM pulse EM2 may be applied, a first electrode connected to the third node DRS, and a second electrode connected to the fourth node n4.

Figure 5A:
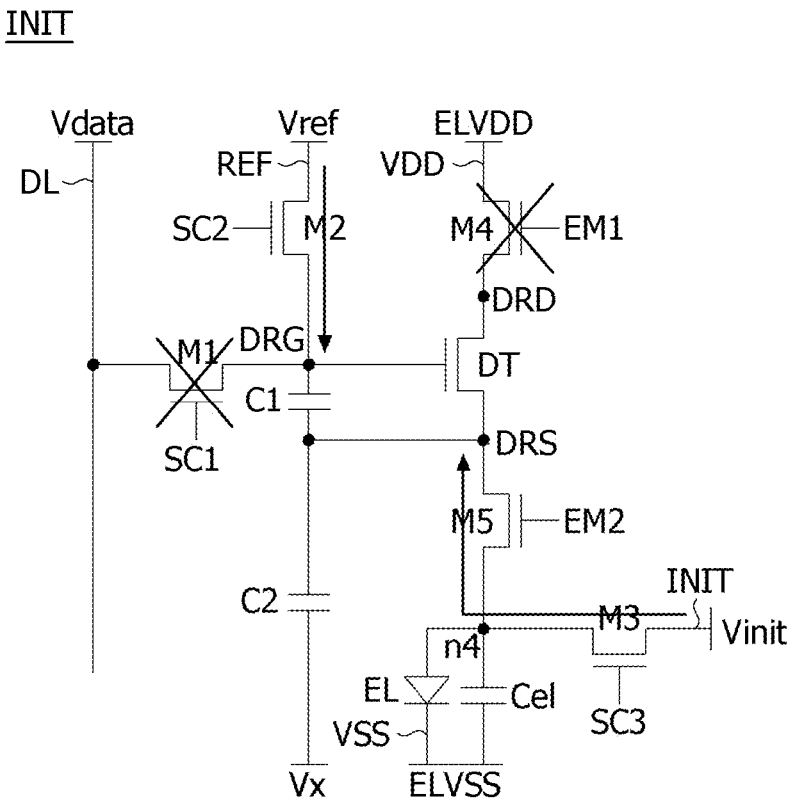
FIG. 5A is a diagram illustrating a current flowing through the example pixel circuit shown in FIG. 3 in an initialization period.

FIG. 5A is a diagram illustrating a current flowing through the example pixel circuit shown in FIG. 3 in the initialization period INIT. In the initialization period INIT, the second, third, and fifth switch elements M2, M3, and M5 may be turned on. In the initialization period INIT, the first and fourth switch elements M1 and M4 may be turned off. In the initialization period INIT, the voltages of the main nodes DRD, DRG, and DRS may be Vref+Vth, Vref, and Vinit, respectively. Here, "Vth" is the threshold voltage of the driving element DT. Accordingly, since the gate-source voltage Vgs of the driving element DT may have a value of Vref-Vinit greater than the threshold voltage Vth in the initialization period INIT, the driving element DT may be turned on.

Figure 5B:
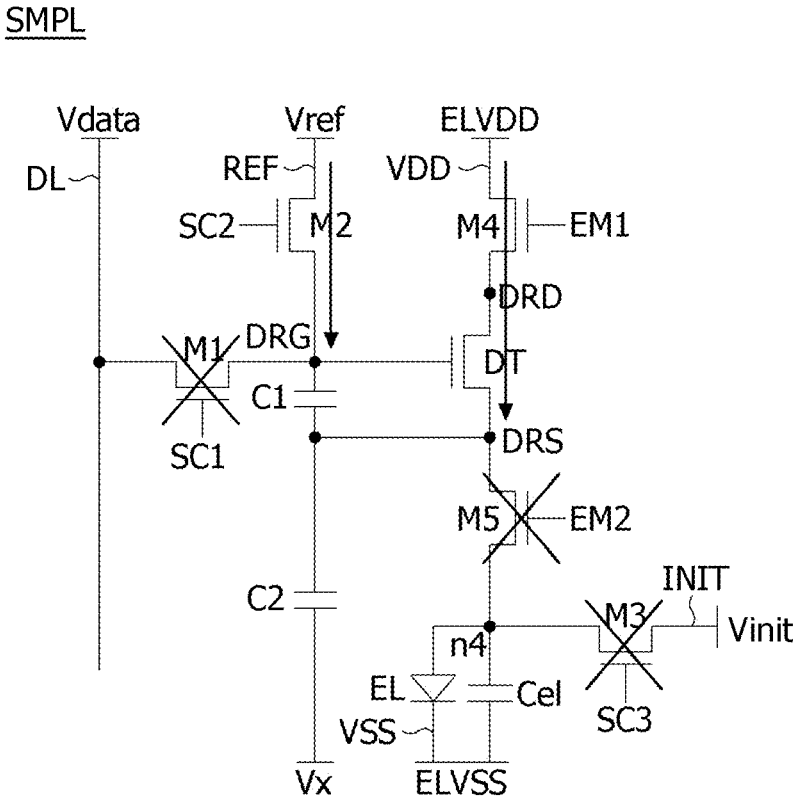
FIG. 5B is a diagram illustrating a current flowing through the example pixel circuit shown in FIG. 3 in a sampling period.

FIG. 5B is a diagram illustrating a current flowing through the example pixel circuit shown in FIG. 3 in the sampling period SMPL. In the sampling period SMPL, the second and fourth switch elements M2 and M4 may be turned on, while the other switch elements M1, M3 and M5 may be turned off. In the sampling period SMPL, when the voltage of the third node DRS rises to make the gate-source voltage Vgs of the driving element DT reach the threshold voltage Vth, the driving element DT is turned off. At the end of the sampling period SMPL, the voltages of the main nodes DRD, DRG, and DRS may be ELVDD, Vref, and Vref-Vth, respectively. Accordingly, when the sampling period SMPL ends, the gate-source voltage Vgs of the driving element DT may become equal to the threshold voltage Vth. The threshold voltage Vth of the driving element DT sampled in this way may be charged in the first capacitor C1.

Figure 5C:
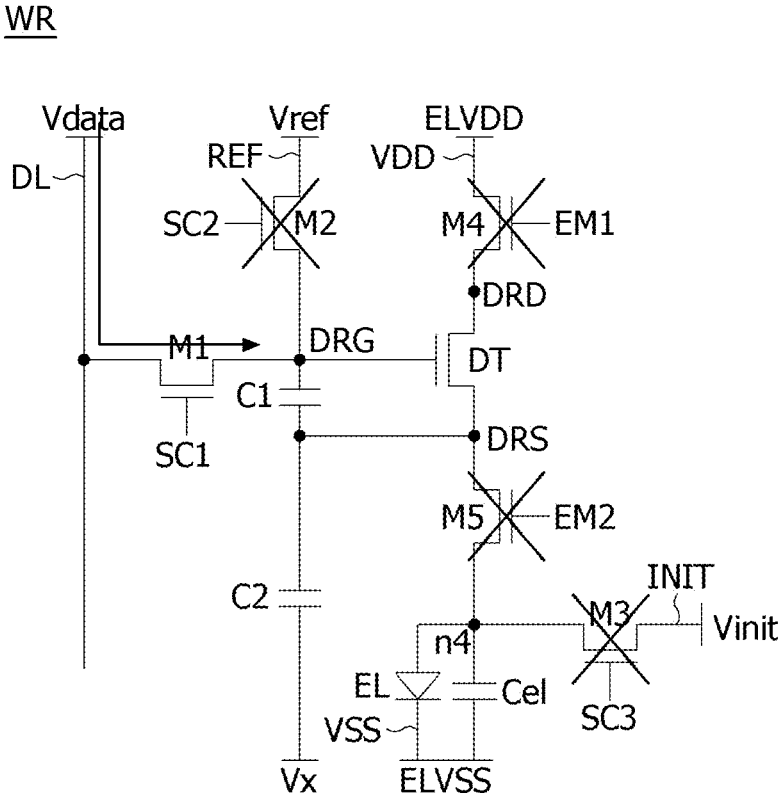
FIG. 5C is a diagram illustrating a current flowing through the example pixel circuit shown in FIG. 3 in an addressing period.

FIG. 5C is a diagram illustrating a current flowing through the example pixel circuit shown in FIG. 3 in the addressing period WR. In the addressing period WR, the first switch element M1 may be turned on to apply the data voltage Vdata of the pixel data to the second node DRG. At this time, the other switch elements M2, M3, M4, and M5 may be turned off. At the end of the addressing period WR, the voltages of the main nodes DRD, DRG, and DRS may be changed to ELVDD, Vdata, and Vref−Vth+C'*(Vdata-Vref), respectively. Here, C'=C1/(C1+C2). The gate-source voltage Vgs of the driving element DT may be changed to a value of (1-C')*(Vdata-Vref)+Vth in the addressing period WR.

As shown in FIGS. 5B and 5C, in the sampling period SMPL and the addressing period WR, the third node DRS may be electrically disconnected from the fourth node n4. As a result, since the data addressing and threshold voltage sampling of the driving element DT are not affected by the resistance of the light emitting element EL and the process deviation of the light emitting element EL, the influence of the light emitting element EL on the luminance of the pixel may be prevented.

Figure 5D:
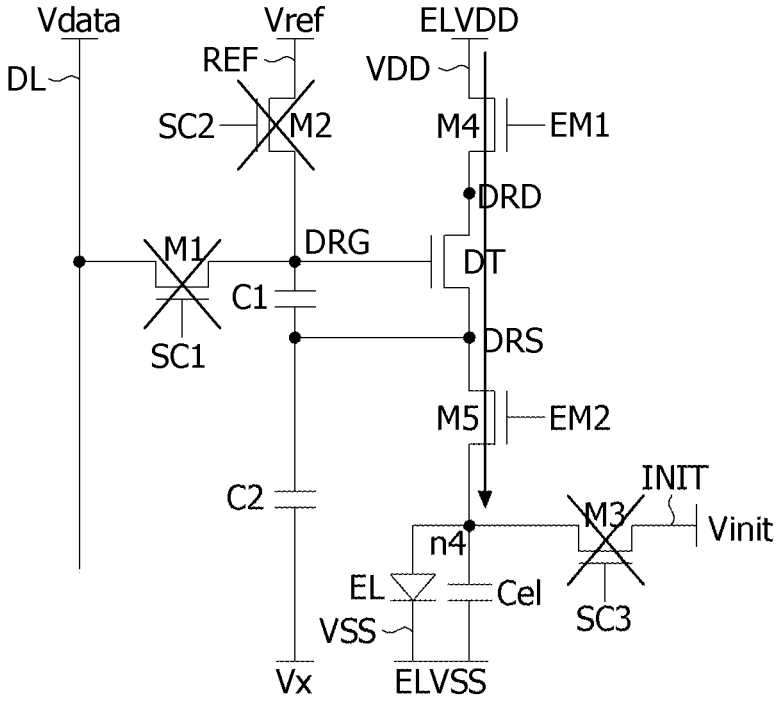
FIG. 5D is a diagram illustrating a current flowing through the example pixel circuit shown in FIG. 3 in a light emission period.

FIG. 5D is a diagram showing a current flowing through the example pixel circuit shown in FIG. 3 in the light emission period EMIS. In the light emission period EMIS, the fourth and fifth switch elements M4 and M5 may be turned on, while the other switch elements M1, M2, and M3 may be turned off. In the light emission period EMIS, the voltages of the main nodes DRD, DRG, and DRS may be changed to ELVDD, Vdata, and Vref−Vth+C'*(Vdata-Vref), respectively. In the light emission period EMIS, the voltage of the third node DRS may be equal to an anode voltage Vel of the light emitting element EL. The gate-source voltage Vgs of the driving element DT may have a value of (1-C')*(Vdata-Vref)+Vth in the light emission period EMIS.

Figure 6:
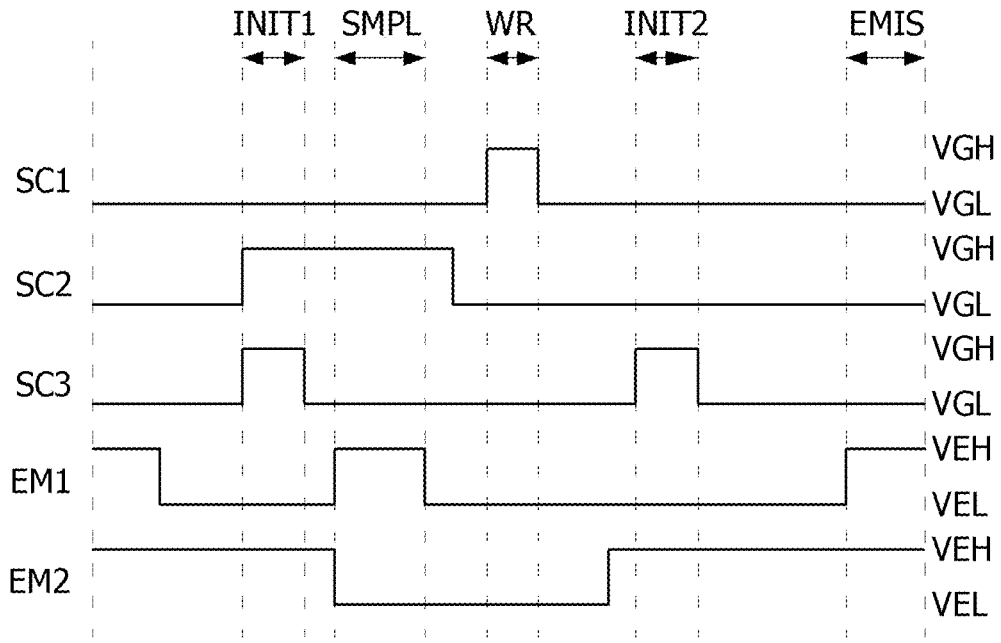
FIG. 6 is a waveform diagram illustrating a method of driving a pixel circuit according to another example embodiment of the present disclosure.
Figure 7:
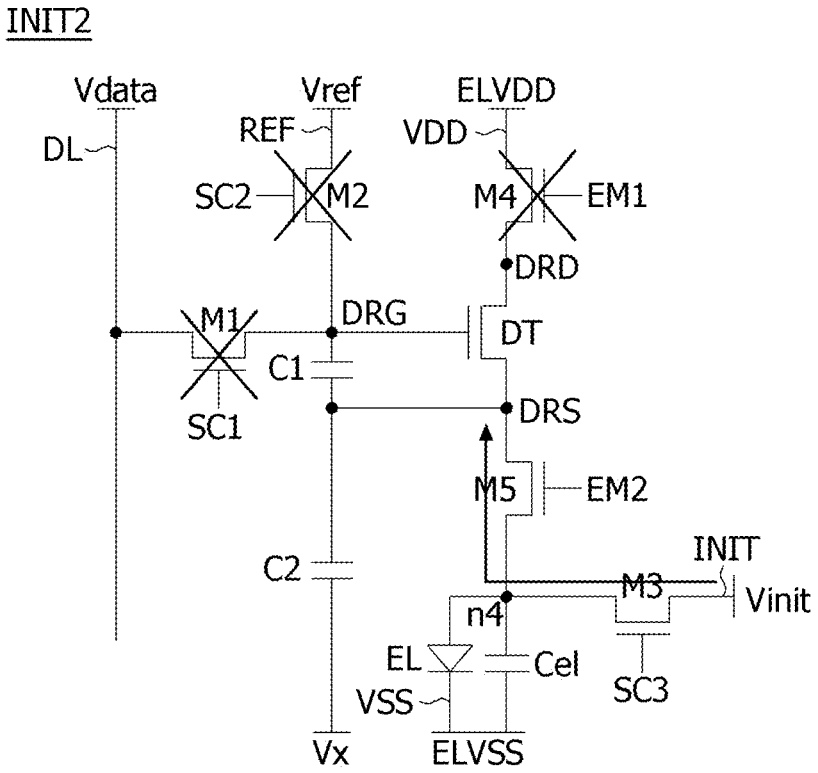
FIG. 7 is a diagram illustrating a current flowing through the example pixel circuit shown in FIG. 3 in a second initialization period.

FIG. 6 is a waveform diagram illustrating a method of driving a pixel circuit according to another example embodiment of the present disclosure. FIG. 7 is a diagram illustrating a current flowing through the example pixel circuit shown in FIG. 3 in a second initialization period INIT2. In this example embodiment, descriptions substantially the same as those of the above-described example embodiment may be omitted. As shown in FIG. 6, a driving period of the pixel circuit may include a first initialization period INIT1, a sampling period SMPL set following the first initialization period INIT1, an addressing period WR set following the sampling period SMPL, a second initialization period INIT2 set following the addressing period WR, and a light emission period EMIS set following the second initialization period INIT2.

As shown in FIGS. 3, 6, and 7, the first scan pulse SC1 may be generated as the gate-on voltage VGH in the addressing period WR in synchronization with the data voltage Vdata of the pixel data. The first scan pulse SC1 may be the gate-off voltage VGL in the first initialization period INIT1, the sampling period SMPL, the second initialization period INIT2, and the light emission period EMIS. The second scan pulse SC2 may be generated as the gate-on voltage VGH in the first initialization period INIT1 and the sampling period SMPL. The second scan pulse SC2 may be the gate-off voltage VGL in the addressing period WR, the second initialization period INIT2, and the light emission period EMIS. The third scan pulse SC3 may be generated as the gate-on voltage VGH in the first initialization period INIT1 and the second initialization period INIT2. The third scan pulse SC3 may be the gate-off voltage VGL in the sampling period SMPL, the addressing period WR, and the light emission period EMIS.

The first EM pulse EM1 may be a gate-off voltage VEL in the first initialization period INIT1, the addressing period WR, and the second initialization period INIT2. The first EM pulse EM1 may be generated as the gate-on voltage VEH in the sampling period SMPL and the light emission period EMIS.

The second EM pulse EM2 may be generated as the gate-on voltage VEH in the first initialization period INIT1, the second initialization period INIT2, and the light emission period EMIS. The second EM pulse EM2 may be the gate-off voltage VEL in the sampling period SMPL and the addressing period WR.

In the first initialization period INIT1, as shown in FIG. 5A, the second, third, and fifth switch elements M2, M3, and M5 may be turned on. In the first initialization period INIT1, the first and fourth switch elements M1 and M4 may be turned off. In the sampling period SMPL, as shown in FIG. 5B, the second and fourth switch elements M2 and M4 may be turned on, while the other switch elements M1, M3, and M5 may be turned off. In the addressing period WR, as shown in FIG. 5C, the first switch element M1 may be turned on to apply the data voltage Vdata of the pixel data to the second node DRG. At this time, the other switch elements M2, M3, M4, and M5 may be turned off.

In the second initialization period INIT2, as shown in FIG. 7, the third and fifth switch elements M3 and M5 may be turned on, and the other switch elements M1, M2, and M4 may be turned off. In the second initialization period INIT2, the voltage of the third node DRS may be initialized to the initialization voltage Vinit. At this time, the voltage of the second node DRG may also be increased by the initialization voltage Vinit, so that the gate-source voltage Vgs of the driving element DT may be maintained at the voltage set in the addressing period WR.

In the light emission period EMIS, as shown in FIG. 5D, the fourth and fifth switch elements M4 and M5 may be turned on, while the other switch elements M1, M2, and M3 may be turned off. In the light emission period EMIS, the light emitting element EL may be driven by a current generated according to the gate-source voltage Vgs of the driving element DT to emit light with a luminance corresponding to the grayscale value of the pixel data.

The objects to be achieved by the present disclosure, the means for achieving the objects, and effects of the present disclosure described above do not specify essential features of the claims. Thus, the scope of the claims is not limited to the example embodiments of the present disclosure.

Although the example embodiments of the present disclosure have been described in more detail with reference to the accompanying drawings, the present disclosure is not limited thereto and may be embodied in many different forms without departing from the technical concept of the present disclosure. Therefore, the example embodiments disclosed in the present disclosure are provided for illustrative purposes only and are not intended to limit the technical concept of the present disclosure. Therefore, it should be understood that the above-described example embodiments are illustrative in all aspects and do not limit the present disclosure.

It will be apparent to those skilled in the art that various modifications and variations can be made in the present disclosure without departing from the spirit or scope of the disclosures. Thus, it is intended that the present disclosure covers such modifications and variations of this disclosure, provided that they come within the scope of the appended claims and their equivalents.

What is claimed is:

1. A pixel circuit, comprising:

a driving element including a first electrode connected to a first node configured to receive a first constant voltage, a gate electrode connected to a second node, and a second electrode connected to a third node;

a light emitting element including an anode electrode connected to a fourth node and a cathode electrode configured to receive a second constant voltage lower than the first constant voltage;

a first switch configured to provide a data voltage to the second node based on a first gate pulse;

a second switch configured to provide a third constant voltage lower than the first constant voltage to the second node based on a second gate pulse;

a third switch configured to provide a fourth constant voltage lower than the third constant voltage and higher than the second constant voltage to the fourth node based on a third gate pulse;

a fourth switch configured to provide the first constant voltage to the first node based on a fourth gate pulse;

a fifth switch configured to electrically connect the third node to the fourth node based on a fifth gate pulse;

a first capacitor connected between the second node and the third node; and a second capacitor connected between the third node and a constant voltage node.

2. The pixel circuit of claim 1, wherein the constant voltage node is configured to receive one of the first, second, third, and fourth constant voltages.

3. The pixel circuit of claim 1, wherein a voltage difference between the third constant voltage and the fourth constant voltage is higher than a threshold voltage of the driving element.

4. The pixel circuit of claim 1, wherein a driving period of the pixel circuit includes an initialization period, a sampling period following the initialization period, an addressing period following the sampling period, and a light emission period following the addressing period, and wherein:

in the initialization period, the second, third, and fifth switches and the driving element are configured to be turned on, and the first and fourth switches are configured to be turned-off, in the sampling period, the second and fourth switches are configured to be turned on, and the first, third, and fifth switches are configured to be turned off, in the addressing period, the first switch is configured to be turned on, and the second, third, fourth, and fifth switches are configured to be turned off, and in the light emission period, the fourth and fifth switches are configured to be turned on, and the first, second, and third switches are configured to be turned off.

5. The pixel circuit of claim 4, wherein the driving element is configured to be turned on in the initialization period and to be turned off in the sampling period.

6. The pixel circuit of claim 4, wherein the third node is configured to be electrically disconnected from the fourth node in the sampling period and the addressing period.

7. The pixel circuit of claim 4, wherein:

the first to the fifth switches are configured to be turned on in response to a gate-on voltage and turned-off in response to a gate-off voltage, the first gate pulse is configured to be generated as the gate-on voltage in the addressing period in synchronization with the data voltage, and to be generated as the gate-off voltage in the initialization period, the sampling period, and the light emission period, the second gate pulse is configured to be generated as the gate-on voltage in the initialization period and the sampling period, and to be generated as the gate-off voltage in the addressing period and the light emission period, the third gate pulse is configured to be generated as the gate-on voltage in the initialization period, and to be generated as the gate-off voltage in the sampling period, the addressing period, and the light emission period, the fourth gate pulse is configured to be generated as the gate-on voltage in the sampling period and the light emission period, and to be generated as the gate-off voltage in the initialization period and the addressing period, and the fifth gate pulse is configured to be generated as the gate-on voltage in the initialization period and the light emission period, and to be generated as the gate-off voltage in the sampling period and the addressing period.

8. The pixel circuit of claim 1, wherein a driving period of the pixel circuit includes a first initialization period, a sampling period following the first initialization period, an addressing period following the sampling period, a second initialization period following the addressing period, and a light emission period following the second initialization period, and wherein:

in the first initialization period, the second, third, and fifth switches and the driving element are configured to be turned on, and the first and fourth switches are configured to be turned-off, in the sampling period, the second and fourth switches are configured to be turned on, and the first, third, and fifth switches are configured to be turned off, in the addressing period, the first switch is configured to be turned on, and the second, third, fourth, and fifth switches are configured to be turned off, in the second initialization period, the third and fifth switches are configured to be turned on, and the first, second, and fourth switches are configured to be turned off, and in the light emission period, the fourth and fifth switches are configured to be turned on, and the first, second, and third switches are configured to be turned off.

9. The pixel circuit of claim 8, wherein:

the first to the fifth switches are configured to be turned on in response to a gate-on voltage and to be turned-off in response to a gate-off voltage, the first gate pulse is configured to be generated as the gate-on voltage in the addressing period in synchronization with the data voltage, and to be generated as the gate-off voltage in the first initialization period, the sampling period, the second initialization period, and the light emission period, the second gate pulse is configured to be generated as the gate-on voltage in the first initialization period and the sampling period, and to be generated as the gate-off voltage in the addressing period, the second initialization period, and the light emission period, the third gate pulse is configured to be generated as the gate-on voltage in the first initialization period and the second initialization period, and to be generated as the gate-off voltage in the sampling period, the addressing period, and the light emission period, the fourth gate pulse is configured to be generated as the gate-on voltage in the sampling period and the light emission period, and to be generated as the gate-off voltage in the first initialization period, the addressing period, and the second initialization period, and the fifth gate pulse is configured to be generated as the gate-on voltage in the first initialization period, the second initialization period, and the light emission period, and to be generated as the gate-off voltage in the sampling period and the addressing period.

10. The pixel circuit of claim 1, wherein a gate-source voltage of the driving element is configured to depend on a capacitance of the second capacitor, and wherein the gate-source voltage of the driving element is configured to change based on the data voltage.

11. A display device, comprising:

a display panel including a plurality of data lines, a plurality of gate lines intersecting the plurality of data lines, a plurality of power lines, and a plurality of pixel circuits respectively connected to the plurality of data lines, the plurality of gate lines, and the plurality of power lines;

a data driver configured to provide a data voltage of pixel data to the plurality of data lines; and a gate driver configured to provide a gate signal to the plurality of gate lines, wherein at least one of the plurality of pixel circuits includes:

a driving element including a first electrode connected to a first node configured to receive a first constant voltage, a gate electrode connected to a second node, and a second electrode connected to a third node;

a light emitting element including an anode electrode connected to a fourth node and a cathode electrode configured to receive a second constant voltage lower than the first constant voltage;

a first switch configured to provide the data voltage to the second node based on a first gate pulse;

a second switch configured to provide a third constant voltage lower than the first constant voltage to the second node based on a second gate pulse;

a third switch configured to provide a fourth constant voltage lower than the third constant voltage and higher than the second constant voltage to the fourth node based on a third gate pulse;

a fourth switch configured to provide the first constant voltage to the first node based on a fourth gate pulse;

a fifth switch configured to electrically connect the third node to the fourth node based on a fifth gate pulse;

a first capacitor connected between the second node and the third node; and a second capacitor connected between the third node and a constant voltage node.

12. The display device of claim 11, wherein the constant voltage node is configured to receive one of the first, second, third, and fourth constant voltages.

13. The display device of claim 11, wherein a voltage difference between the third constant voltage and the fourth constant voltage is higher than a threshold voltage of the driving element.

14. The display device of claim 11, wherein a driving period of the at least one of the pixel circuits includes an initialization period, a sampling period following the initialization period, an addressing period following the sampling period, and a light emission period following the addressing period, and wherein:

in the initialization period, the second, third, and fifth switches and the driving element are configured to be turned on, and the first and fourth switches are configured to be turned-off, in the sampling period, the second and fourth switches are configured to be turned on, and the first, third, and fifth switches are configured to be turned off, in the addressing period, the first switch is configured to be turned on, and the second, third, fourth, and fifth switches are configured to be turned off, and in the light emission period, the fourth and fifth switches are configured to be turned on, and the first, second, and third switches are configured to be turned off.

15. The display device of claim 14, wherein the third node is configured to be electrically disconnected from the fourth node in the sampling period and the addressing period.

16. The display device of claim 14, wherein:

the first, second, third, fourth and fifth switches are configured to be turned on in response to a gate-on voltage and to be turned-off in response to a gate-off voltage, the first gate pulse is configured to be generated as the gate-on voltage in the addressing period in synchronization with the data voltage, and to be generated as the gate-off voltage in the initialization period, the sampling period, and the light emission period, the second gate pulse is configured to be generated as the gate-on voltage in the initialization period and the sampling period, and to be generated as the gate-off voltage in the addressing period and the light emission period, the third gate pulse is configured to be generated as the gate-on voltage in the initialization period, and to be generated as the gate-off voltage in the sampling period, the addressing period, and the light emission period, the fourth gate pulse is configured to be generated as the gate-on voltage in the sampling period and the light emission period, and to be generated as the gate-off voltage in the initialization period and the addressing period, and the fifth gate pulse is configured to be generated as the gate-on voltage in the initialization period and the light emission period, and to be generated as the gate-off voltage in the sampling period and the addressing period.

17. The display device of claim 11, wherein a driving period of the at least one of the pixel circuits includes a first initialization period, a sampling period following the first initialization period, an addressing period following the sampling period, a second initialization period following the addressing period, and a light emission period following the second initialization period, and wherein:

in the first initialization period, the second, third, and fifth switches and the driving element are configured to be turned on, and the first and fourth switches are configured to be turned-off, in the sampling period, the second and fourth switches are configured to be turned on, and the first, third, and fifth switches are configured to be turned off, in the addressing period, the first switch is configured to be turned on, and the second, third, fourth, and fifth switches are configured to be turned off, in the second initialization period, the third and fifth switches are configured to be turned on, and the first, second, and fourth switches are configured to be turned off, and in the light emission period, the fourth and fifth switches are configured to be turned on, and the first, second, and third switches are configured to be turned off.

18. The display device of claim 17, wherein:

the first, second, third, fourth and fifth switches are configured to be turned on in response to a gate-on voltage and to be turned-off in response to a gate-off voltage, the first gate pulse is configured to be generated as the gate-on voltage in the addressing period in synchronization with the data voltage, and to be generated as the gate-off voltage in the first initialization period, the sampling period, the second initialization period, and the light emission period, the second gate pulse is configured to be generated as the gate-on voltage in the first initialization period and the sampling period, and to be generated as the gate-off voltage in the addressing period, the second initialization period, and the light emission period, the third gate pulse is configured to be generated as the gate-on voltage in the first initialization period and the second initialization period, and to be generated as the gate-off voltage in the sampling period, the addressing period, and the light emission period, the fourth gate pulse is configured to be generated as the gate-on voltage in the sampling period and the light emission period, and to be generated as the gate-off voltage in the first initialization period, the addressing period, and the second initialization period, and the fifth gate pulse is configured to be generated as the gate-on voltage in the first initialization period, the second initialization period, and the light emission period, and to be generated as the gate-off voltage in the sampling period and the addressing period.

19. The display device of claim 11, wherein the first switch is configured to provide the data voltage from a corresponding one of the data lines to the second node based on the first gate pulse, and wherein the second switch is configured to provide the third constant voltage from one of the power lines to the second node based on the third gate pulse.

20. The display device of claim 11, wherein a gate-source voltage of the driving element is configured to depend on a capacitance of the second capacitor, and wherein the gate-source voltage of the driving element is configured to change based on the data voltage.

* * * * *